US007314498B2

(12) United States Patent
Nigarura et al.

(10) Patent No.: US 7,314,498 B2
(45) Date of Patent: Jan. 1, 2008

(54) SINTERED ALLOYS FOR CAM LOBES AND OTHER HIGH WEAR ARTICLES

(75) Inventors: Salvator Nigarura, Centerville, OH (US); Juan R.L. Trasorras, Ann Arbor, MI (US)

(73) Assignee: PMG Ohio Corp., Dayton, OH (US)

( * ) Notice: Subject to any disclaimer, the term of this patent is extended or adjusted under 35 U.S.C. 154(b) by 0 days.

(21) Appl. No.: 10/967,983

(22) Filed: Oct. 19, 2004

(65) Prior Publication Data

US 2006/0081089 A1 Apr. 20, 2006

(51) Int. Cl.
*B22F 3/12* (2006.01)
*B22F 3/24* (2006.01)
*B22F 5/10* (2006.01)

(52) U.S. Cl. ..... 75/246; 419/26; 419/29

(58) Field of Classification Search ..... 75/243, 75/246; 419/11, 26
See application file for complete search history.

(56) References Cited

U.S. PATENT DOCUMENTS

| | | | | | |
|---|---|---|---|---|---|
| 2,333,573 | A | * | 11/1943 | Kalischer | 419/59 |
| 3,698,877 | A | | 10/1972 | Motoyoshi | 29/182 |
| 4,230,506 | A | | 10/1980 | Clark | 148/3 |
| 4,243,414 | A | | 1/1981 | Takahashi et al. | 75/244 |
| 4,783,898 | A | * | 11/1988 | Kanamaru et al. | 29/523 |
| 4,829,950 | A | * | 5/1989 | Kanamaru et al. | 123/90.51 |
| 4,870,931 | A | | 10/1989 | Nakamura et al. | 123/90 |
| 4,969,262 | A | | 11/1990 | Hiraoka et al. | 29/888.1 |
| 5,476,632 | A | | 12/1995 | Shivanath et al. | 419/57 |
| 5,540,883 | A | | 7/1996 | Jones et al. | 419/28 |
| 5,613,180 | A | * | 3/1997 | Kosco | 419/5 |
| 5,659,873 | A | | 8/1997 | Seyrkammer | 419/29 |
| 6,123,748 | A | | 9/2000 | Whitaker et al. | 75/252 |
| 6,338,747 | B1 | | 1/2002 | Kosco | 75/243 |
| 6,473,964 | B1 | | 11/2002 | Anderson et al. | 29/888.1 |
| 6,632,263 | B1 | | 10/2003 | Nigarura et al. | 75/231 |
| 2001/0012490 | A1 | | 8/2001 | Yamauchi | 419/6 |
| 2003/0029272 | A1 | | 2/2003 | Vidarsson et al. | 75/252 |

FOREIGN PATENT DOCUMENTS

| | | | | |
|---|---|---|---|---|
| GB | 2 187 757 A | | 9/1987 | 38/32 |
| GB | 2 298 869 A | | 9/1999 | 33/22 |
| JP | 357108246 | * | 7/1982 | |
| JP | 61044152 | | 3/1986 | 33/2 |

OTHER PUBLICATIONS

Chatterley, T.C., "Cam and Cam Follower Reliability," SAE Paper 885033, 1988.

Nakamura, Yoshikatz; Egami Yasuyoshi, "Development of an Assembled Camshaft by Mechanical Bonding" SAE Paper 960302, 1996.

Wilkes, F.C. "Summary Report on the Performance of a Number of Cam and Cam Follower Material Combinations Tested in the MIRA Cam and Follower Test Machine," Mira Report No. 3 1970.

* cited by examiner

*Primary Examiner*—Ngoclan T. Mai
(74) *Attorney, Agent, or Firm*—Metz Lewis LLC; Barry I. Friedman

(57) ABSTRACT

An iron-based sintered powder metal article for cam lobe and other high temperature, high wear applications requiring excellent net-shape stability during sintering comprises a powder metal mixture consisting essentially of, by weight, 0.5–3.0% Mo, 1–6.5% Cr, 1–5% V, and the balance Fe and impurities. These articles also have a carburized case having 0.7–1.2% C by weight. Following carburization of the case, the articles are quenched to form a martensitic matrix having a network of disbursed carbides of Cr and V. The resulting sintered articles have good mechanical strength and wear resistance and possess excellent machineability and dimensional stability.

32 Claims, 4 Drawing Sheets

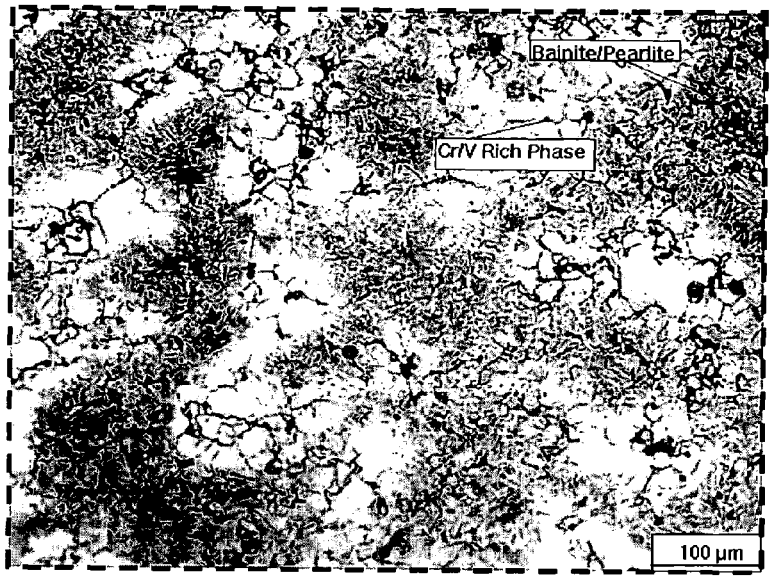

FIG. 7

Cam & Tappet PM Tests - V V T

| Comment | Material | Sample | Shim | Stress | Oil | Test No. | Speed (rpm) | Time (Hrs) | Result | STATUS |
|---|---|---|---|---|---|---|---|---|---|---|
| | | | | | | | | | | |
| sinter harden | Fe-Ni-Mo-C | A | 100Cr6 | 600 | Largo P1 | 238/2 | 500 | 50 | **Fail** | Finished |
| lowest density | | B | 100Cr6 | 500 | Largo P1 | 242/2 | 500 | 50 | OK | Finished |
| cheapest | | C | 100Cr6 | 500 | Largo P1 | 246/2 | 500 | 50 | OK | Finished |
| | | | | | | | | | | |
| | | | | | | | | | | |
| case harden | Fe-Mo-Cr-V-C | A | 100Cr6 | 600 | Largo P1 | 239/3 | 500 | 100 | OK | Finished |
| medium density | | B | 100Cr6 | 600 | Largo P1 | 243/3 | 500 | 50 | OK | |
| | | B | 100Cr6 | 700 | Largo P1 | 243/3 | 500 | 50 | OK | Finished |
| | | C | PM | 600 | Largo P1 | 247/3 | 500 | 50 | OK | Finished |
| | | D | PM | 700 | Largo P1 | 251/3 | 500 | 50 | OK | Finished |
| | | E | PM | 800 | AL 3612 | 254/1 | 500 | 50 | OK | |
| | | E | PM | 850 | AL 3612 | 254/1 | 700 | 50 | OK | |
| | | E | PM | 900 | AL 3612 | 254/1 | 700 | 50 | OK | Finished |
| | | F | 100Cr6 | 800 | AL 3612 | 255/5 | 700 | 35.7 | OK | |
| | | F | 100Cr6 | 850 | AL 3612 | 255/5 | 700 | 50 | OK | |
| | | F | 100Cr6 | 900 | AL 3612 | 255/5 | 700 | 50 | OK | Finished |
| | | | | | | | | | | |
| | | | | | | | | | | |
| case harden | Fe-Mo-C | A | 100Cr6 | 600 | Largo P1 | 240/4 | 500 | 50 | **Fail** | Finished |
| high density | | B | 100Cr6 | 500 | Largo P1 | 244/4 | 500 | 50 | **Fail** | Finished |
| | | C | 100Cr6 | 400 | Largo P1 | 248/4 | 500 | 50 | OK | Finished |
| | | D | 100Cr6 | 400 | Largo P1 | 252/4 | 500 | 50 | OK | Finished |
| | | | | | | | | | | |
| | | | | | | | | | | |
| case harden | Fe-Mo-C | A | 100Cr6 | 600 | Largo P1 | 241/5 | 500 | 50 | **Fail** | Finished |
| very high density | | B | 100Cr6 | 500 | Largo P1 | 245/5 | 500 | 50 | OK | Finished |
| | | C | 100Cr6 | 500 | Largo P1 | 249/5 | 500 | 50 | OK | Finished |

FIG. 8

SINTERED ALLOYS FOR CAM LOBES AND OTHER HIGH WEAR ARTICLES

BACKGROUND OF THE INVENTION

1. Technical Field

This invention relates generally to powder metallurgy. More particularly, the invention relates to sintered iron-based powder metal alloy articles that are suitable for use in high-wear applications. Most particularly, the invention relates to sintered iron-based powder metal articles, such as valve train components, including cam lobes and other valve components.

2. Related Art

The valve train of an internal combustion engine typically includes one or more camshafts. Camshafts for piston-driven internal combustion engines typically include several cam lobes with lobe-shaped outer surfaces that operate to move push rods, lifters or other movable members in a precise pattern. As the camshaft rotates, the cam lobes must engage the movable members at proper positions and with proper timing. Therefore, the cam lobes must be positioned on the camshaft at precise relative axial positions and angular orientations. Camshafts and their associated cam lobes are examples of components that are subject to sliding wear processes. These components have been produced by machining from unitary cast, forged or bar stock material. Recently, there has been a trend towards the use of assembled camshafts in order to reduce weight and offer design flexibility with respect to material selection for the high-wear surfaces and components, such as cam lobes, bearings, and other components. Assembled camshafts have been recognized as offering a cost-effective alternative as compared to traditional machined camshafts, as well as offering improved product quality and performance characteristics. Currently, the main application of assembled camshafts is in valve trains with roller followers, which require high fatigue strength in rolling contact. Cam lobe materials used in such applications are produced by forging of various types of cast or bar stock blanks, as well as powder forging and sintering. Assembled camshafts are not typically used for application in valve trains with sliding followers. Assembled camshafts are not used for sliding applications due to the tribologicial incompatibility between current cam lobe materials and the follower (tappet shim) material. This incompatibility results in the scuffing/pitting of the cam lobe and the follower.

In valve trains with sliding followers, cast camshafts are used, and in particular cast camshafts made using chilled cast iron. The superiority of chilled cast iron (CCI) over alternative materials such as hardenable steel when used under sliding contact conditions in traditional valve train designs has been proved. The use of chilled cast iron cam lobes for assembled camshaft applications has been considered, but generally has not been utilized because of limitations associated with the accuracy of the cast cam lobe components and the necessity of utilizing relatively expensive secondary machining operations to obtain the necessary dimensional accuracy of the finished cam lobes. However, the expanded use and development of multi-valve engines necessitates the use of camshafts with more design flexibility, including high wear resistance, assembled camshaft as opposed to unitary cast camshaft construction and near net shape forming of precision elements, such as cam lobes.

In order to fulfill these requirements, the use of powder metal technology has been considered for manufacturing portions of the camshaft from subassembly. However, less than fully dense powder metal components (i.e., those which are not sintered together with the application of pressure or the use of specialized sintering techniques to obtain full density, such as liquid phase sintering) have been unable to achieve the wear performance of chilled cast irons. Successful applications of powder metal alloys in sliding applications have been reported in U.S. Pat. No. 4,243,414 and UK Patent 2,187,757. These patents teach the use of highly alloyed powder metal compositions that are sintered to almost full density via liquid phase sintering. Another example of the reported successful use of powder metal technology in manufacturing cam lobes is disclosed in SAE Publication No. 960302 by Yoshikatsu Nakamura et al. which teaches the use of an Fe—C—P—Ni—Cr—Mo liquid phase sintered alloy to obtain higher pitting and scuffing resistance. As seen from the above examples, the related art teaches the use of highly alloyed materials and specialized sintering techniques, such as liquid phase sintering, in order to achieve high wear resistance.

Alloying with chromium from a mixture of iron, an iron chromium intermetallic compound and carbon is disclosed in U.S. Pat. Nos. 3,698,877, 5,476,632 and 5,540,883. U.S. Pat. No. 3,698,877 teaches a process of making high density parts by mixing iron with carbon and a brittle FeCr in a so-called sigma phase. U.S. Pat. Nos. 5,476,632 and 5,540,883 teach a process of forming a sintered component by blending carbon, a ferro chromium alloy powder and lubricant with compressible elemental powder, pressing the blended mixture to form the article, and then high temperature sintering of the article in a reducing atmosphere or under a vacuum. In these patents, emphasis is placed on alloying with Cr, Mo and Mn through addition of elemental ferro alloys or master alloys in order to achieve high strength without loss of compressibility for the powder mixture, or loss of formability for the as-sintered component. The process described in these patents is designed to produce a homogeneous Cr—Mn—Mo steel through high temperature solid diffusion in a vacuum furnace of elemental alloying elements. Two main groups of alloys are described in the above patents: 1) a group of Mn containing alloys for high strength applications (i.e., Fe—Mn—Mo—Cr—C), and 2) a group of Mn-free alloys for high ductility and post sintering forming operations (i.e., Fe—Mo—Cr—C). In both cases, carbon is added in powder form before compaction. The carbon ranges between 0.1 to 0.6% by weight, and is not sufficient for forming carbides with the alloying elements.

Therefore, it is desirable to develop sintered powder metal alloy materials which may be utilized to make cam lobes for assembled camshaft applications, as well as other high-wear applications, which may be formed to a near-net shape, and which do not require significant secondary machining or other finishing operations, and which do not have the disadvantages of related art sintered powder alloy materials.

SUMMARY OF THE INVENTION

Iron-based sintered powder metal articles of the present invention are fabricated from an iron-based powder admixture consisting essentially of, by weight: 0.5 to 3.0% Mo, 1.0 to 6.5% Cr, 1.0 to 5% V, and the balance iron and impurities. Further, it is preferred that the articles of the present invention be fabricated from an iron-based powder having less than 4% by weight total of alloying elements from the group consisting of Mo, Cr and V, with the balance iron and impurities. The Mo is preferably prealloyed into a base iron powder, the Cr is preferably added in the form of a high carbon ferro chromium powder, and the V is preferably added in the form of a ferro vanadium powder. The articles also preferably comprise an outer surface and case having 0.7 to 1.2% carbon, by weight. The carbon is preferably added by carburization of the articles sufficient to form the carburized case to a desired depth. The articles are also preferably processed, such as by quenching, so as to form a martensitic matrix in the case having finely dispersed chromium and vanadium carbides therein.

The present invention comprises Fe-based sintered powder articles formed from the low alloy Fe-based powder material described above which may be heat treated to form an outer surface and case with wear resistance which is equivalent to or superior to that of articles formed from chilled cast iron. The combined effect of material and processing results in articles with superior wear resistance at the working surface due to the presence of fine carbides of Cr and V dispersed in the hard martensitic microstructure at the surface and in the case.

It is an object of this invention to provide a medium density (7.0 to 7.3 g/cm3) Fe-based sintered powder metal article by compacting an admixture of a high compressibility Fe—Mo pre-alloyed powder base mixed with a high carbon ferro chromium powder and a ferro vanadium powder, sintering the compact in a reducing atmosphere in the solid state, without the need for the formation of a liquid phase for densification purposes, and carburizing and quenching the as-sintered component to form a surface and case which contains chromium and vanadium carbides obtained from the admixed ferroalloys and martensite from the quenching of the molybdenum alloyed and carburized iron, thereby achieving a dual structure comprising a hard martensitic matrix having uniformly dispersed chromium and vanadium carbides.

It is preferred that the Mo is prealloyed into a base iron powder, the Cr is added in the form of a high carbon ferro chromium powder to protect it from oxidation, and the V is added in the form of a ferro vanadium powder. Both elements added in this form can be sintered at conventional sintering temperatures, as compared to the high temperature and vacuum sintering required if high oxygen, low carbon ferro chromium is used.

In contrast to related art alloys, the iron-based powder admixture used to form articles of this invention contains at least 1% chromium and 1% vanadium, and does not contain added graphite to provide carbon in the sintering stage. Carbon in the alloy is introduced by carburizing of the sintered articles. In order to preferentially form chromium and vanadium carbides in the component surface, carburizing is done using a high carbon potential so as to introduce a quantity of carbon to the surface sufficient to form an average of 0.7–1.2% C by weight in the case.

Articles of the present invention have high wear resistance and provide a cost effective replacement for traditional chilled cast iron in sliding wear applications, such as the sliding contacts between the flat faced tappet and the cam lobe in a type 1 valve-train system.

BRIEF DESCRIPTION OF THE DRAWINGS

These and other features and advantages of the present invention will become more readily appreciated when considered in connection with the following detailed description and appended drawings, wherein:

FIG. 7 is an optical photomicrograph taken at 200× of a core region 7 of a sintered powder alloy of the present invention, as illustrated generally in FIG. 4.

FIG. 8 is a table of test results.

DETAILED DESCRIPTION OF THE PREFERRED EMBODIMENT

Figure 1:
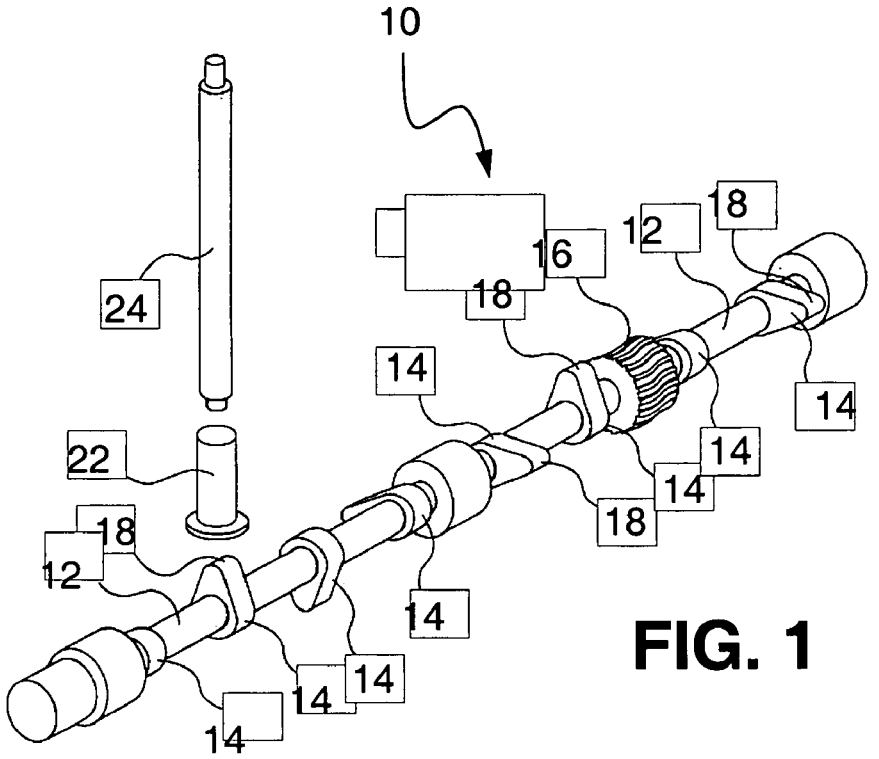
FIG. 1 is a perspective view of a camshaft of the present invention.

An article of the present invention preferably may include a camshaft that incorporates at least one, and preferably a plurality of, cam lobes fabricated from an iron-based sintered powder metal alloy, as further described herein. An assembled camshaft 10 of conventional construction and adapted for use in an internal combustion engine is depicted in FIG. 1. Camshaft 10 generally includes camshaft tube 12. The number of cam lobes 14 required for the engine are affixed to the outer surface of camshaft tube 12. Other camshaft components such as, for example, gear 16, may be affixed to the outer surface of camshaft tube 12. Although generically referred to herein as a "camshaft tube", that element, although typically hollow, need not be cylindrical and may have any overall shape and uniform or non-uniform cross-section suitable for receiving and rotating the several cam lobes and other camshaft components. Accordingly, "camshaft tube" is used herein to refer generally to the central rotating component of camshaft 12 to which the cam lobes 14 are affixed, and is not limited to any particular cylindrical or non-cylindrical configuration.

The lobe-shaped region 18 of each cam lobe 14 has a predetermined cam shape or profile and is dimensioned to accurately control movement of the movable member or members which it engages. More specifically, the profile of the cam lobe 14, and particularly the shape and dimensions of lobe-shaped region 18, are such that as camshaft tube 12 rotates, the motion of cam lobe 14 imparts a precise rocking or reciprocating motion to the movable member it engages. In FIG. 1, for example, the movable members illustrated adjacent cam lobe 14 are lifter 22 and push rod 24. As camshaft 10 rotates, the surface shape and dimensions of each cam lobe 14, along with their various angular and axial positions along the length of the camshaft tube 12, work in conjunction to properly move the push rods 22 of the engine in a desired pattern and timing. This synchronized motion ensures that the intake and exhaust valves of all engine cylinders operate correctly.

Camshafts 10 combining camshaft tube 12 and several cam lobes 14 have traditionally been manufactured from cast iron or steel as a single component as described herein. This has included the use of chilled cast iron to obtain the necessary wear resistance on the cam lobe profiles. These methods of fabrication are time-consuming and expensive, and are known to produce camshafts with limited dimensional accuracy. Therefore, extensive grinding and/or polishing is typically required to shape the individual cam lobes and other camshaft components and appropriately adjust the shape and dimensions of the surfaces of each of the components. Absent such extensive finishing work, the cam lobes would not properly engage their associated movable members. Forged or cast camshafts are necessarily composed of material of a substantially homogenous chemical composition. This is a well-known disadvantage inasmuch as it may be desirable for the camshaft tube and the cam lobes to have substantially different physical properties so as to optimally withstand the significantly different mechanical environment experienced by the several components.

Figure 2:
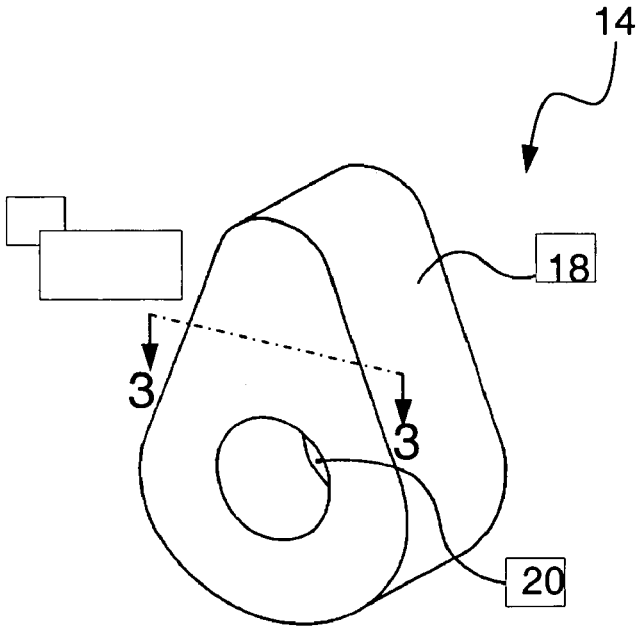
FIG. 2 is a perspective view of a cam lobe of the camshaft of FIG. 1.

According to the invention, camshaft 10 is fabricated by separately producing camshaft tube 12 and cam lobes 14 and then assembling cam lobes 14 onto the outer surface of camshaft tube 12 at desired locations. In the case of camshaft 10 of FIG. 1, for example, individual cam lobes 12 having a configuration as generally shown in FIG. 2 may be separately fabricated and then positioned about camshaft tube 12. The components are assembled by disposing camshaft tube 12 through bore 20 in each cam lobe 14, and then affixing cam lobes 14 to the outer surface of camshaft tube 12 in desired axial positions and angular orientations. This fabrication method provides greater flexibility relative to prior methods, and the materials from which the camshaft tube, the cam lobes, and the other components installed on the camshaft are constructed may differ. For example, cam lobes 14 may be produced from a material particularly resistant to sliding wear, thermal stress and repetitive contact fatigue, while the camshaft tube may be produced from less expensive material such as a machined mild steel.

According to the invention, an article such as cam lobe 14 for use in camshaft 10 of an internal combustion engine is constructed from an Fe-based sintered powder metal composition. An article made from this composition exhibits improved strength and wear resistance for use in high temperature, high wear applications such as cam lobe profile 18 above, and is well suited for valve train applications, although not limited thereto. In addition to the strength and wear resistance properties, articles made from the sintered powder metal composition according to the invention possesses excellent dimensional stability, good machineability, and the ability to be processed at relatively low sintering temperatures, which is advantageous from both a manufacturing and performance point of view.

In addition to cam lobes, the material and process according to the invention has application to other articles where the properties of good strength, wear resistance, machineability and dimensional stability in an iron-based powder metal system are desired. Accordingly, while the description is directed to cam lobes or other associated valve train components (collectively valve wear components) it will be appreciated that the invention is applicable to and contemplates application to other components which require the same or similar properties.

According to a preferred embodiment of the invention, an article comprising a sintered iron-based powder metal valve wear component, such as cam lobe 14, is fabricated from an iron-based powder metal admixture consisting essentially of, by weight: 0.5 to 3.0% Mo, 1.0 to 6.5% chromium, 1.0 to 5% vanadium, and the balance iron and impurities. Table 1 illustrates the compositional range of the sintered articles, as well as a preferred compositional selection from within this range and described below with regard to Example 1.

TABLE 1

| | Weight % | |
|---|---|---|
| Alloying Element | Range | Example 1 |
| Mo | 0.5–3.0 | 0.85 |
| Cr | 1–6.5 | 2 |

TABLE 1-continued

| | Weight % | |
|---|---|---|
| Alloying Element | Range | Example 1 |
| V | 1–5 | 1 |
| Fe | Balance | Balance |

The iron-based powder metal admixture is compacted to a medium density of about 7.0–7.3 g/cm$^3$ to the desired net-shape size of the valve wear component article, such as cam lobe 14. The article is then sintered in a reducing atmosphere or in vacuum at a relatively low sintering temperature of between about 1121° C. (2050° F.) to 1260° C. (2300° F.) to achieve a fully sintered structure. The sintered article is then heat treated in a carburizing environment in order to produce a carbon content on the surface of the sintered alloy article of about 0.7–1.2% C, by weight. It is preferred that this carbon concentration exists not only at the surface of the article, but that it also extends to a case depth of between about 0.5 to 1 mm. Carburizing may be performed by any suitable carburizing method, but will preferably be performed in a carburizing atmosphere at a temperature in the range of 954° C. (1750° F.) to 1037° C. (1900° F.). Carburizing will also preferably be performed using a carbon potential that is higher than that required to obtain the desired carbon concentration in the case. It is believed that this approach may promote the formation of an even greater concentration of carbides at surface 30 of the article. The sintering is done completely in the solid state and does not require or result in the creation of a liquid phase in order to achieve a fully dense microstructure in the sintered article having excellent wear resistance, machineability, and dimensional stability, as will be explained below with reference to the example given herein.

Figure 3:
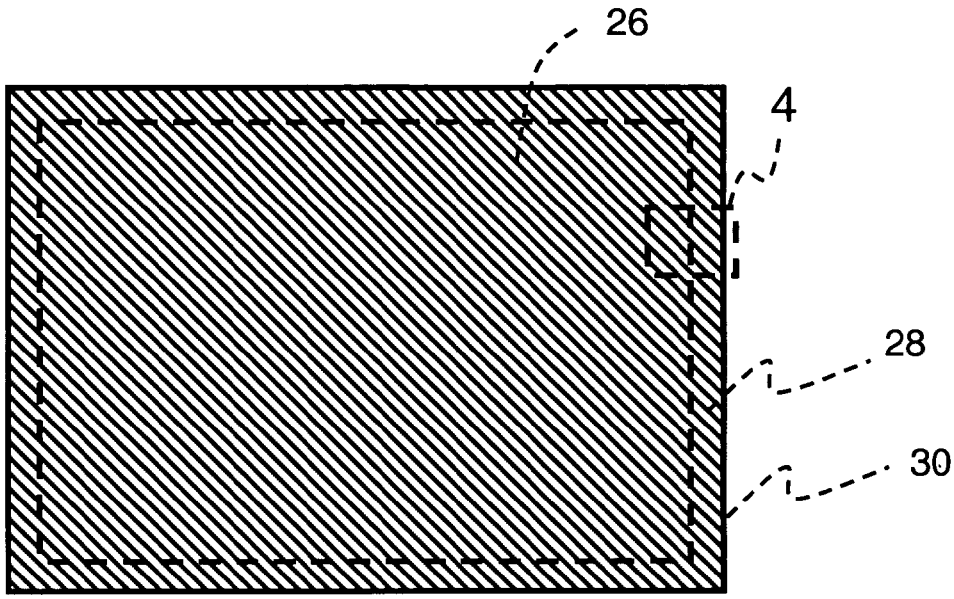
FIG. 3 is a section view taken along section 3—3 of FIG. 2.
Figure 4:
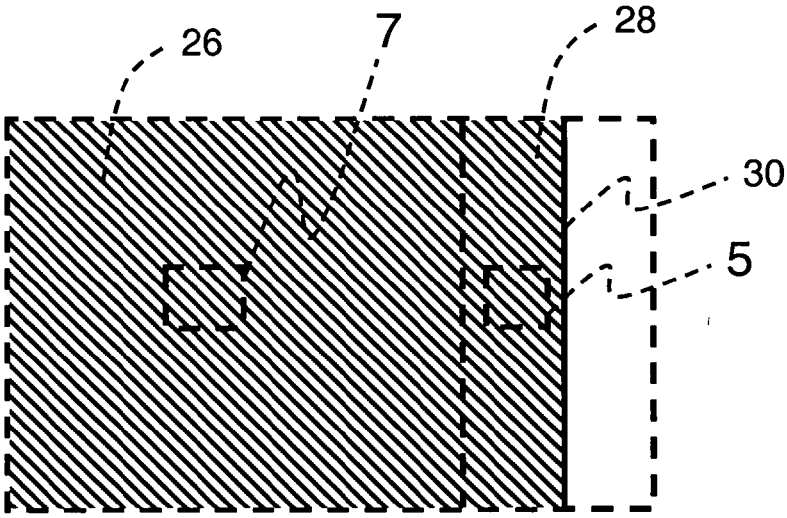
FIG. 4 is an enlargement of region 4 of FIG. 3.
Figure 5:
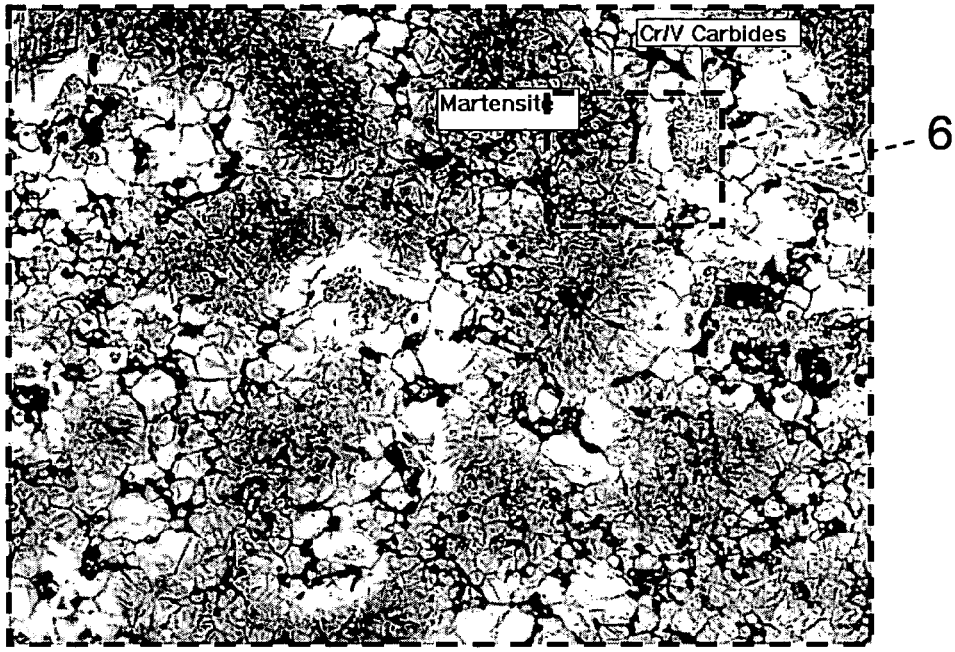
FIG. 5 is an optical photomicrograph taken at 200× within a surface region 5 of a sintered powder alloy of the present invention, as illustrated generally in FIG. 4.
Figure 6:
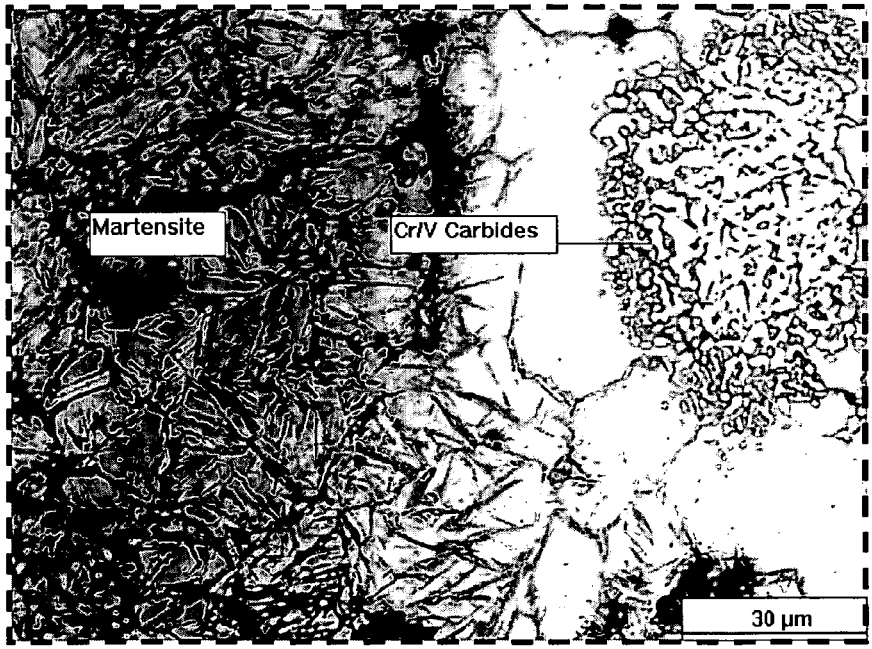
FIG. 6 is an optical photomicrograph taken at 1000× of region 6 of FIG. 5.

Referring to FIGS. 3 and 4, articles of the invention will have a low alloy Fe-base core 26 and a carburized case 28 including outer surface 30. FIGS. 5 and 6 are optical photomicrographs of carburized case 28 with indications of a dispersed network of chromium and vanadium carbides and a martensite matrix. FIG. 7 is an optical photomicrograph of core region 26 with indications of a bainite/pearlite matrix as well as Cr/V rich phase locations.

The powder admixture preferably comprises a base Fe powder which consists essentially of a pre-alloyed iron powder containing about 0.5 to 3.0% by weight of Mo and the balance Fe and impurities. The base Fe—Mo alloy powder can be obtained commercially from a number of powder metal suppliers. Table 1 illustrates a typical distribution of particle sizes for the base Fe powder.

TABLE 2

| Particle Size Analysis; Weight % | +250 μm | −250 to +150 μm | −150 to +45 μm | −45 μm |
|---|---|---|---|---|
| | trace | 9.9 | 65.9 | 24.2 |

The powder admixture also includes 1 to 6.5% chromium by weight. The chromium is added for the purpose of forming carbides in order to promote the development of the carbide network in case 28 and the outer surface 30 of the article. The chromium is preferably added to the admixture as a high carbon ferro chromium powder. Such ferro chromium powders are commercially available. An example of the composition of an exemplary commercially available ferro chromium powder is provided in Table 3.

TABLE 3

| Ferroalloy | Cr; wt % | | C; wt % | | Size; μm | |
|---|---|---|---|---|---|---|
| | Range | Typical | Range | Typical | Range | Typical |
| FeCr | 60–75 | 70 | 6–8 | 7 | 0–45 | 10 |
| FeV | 50–60 | 55 | 0–1 | 0.2 | 0–25 | 10 |

The powder admixture also includes vanadium in the range of 1–5% by weight. The vanadium is also added to promote the formation of the network of dispersed carbides in case 28 and particularly at outer surface 30 of the article. Such ferro vanadium powders are commercially available. The composition and size distribution of a typical commercially available ferro vanadium powder is also provided in Table 3.

EXAMPLE 1

In order to evaluate the performance of cam lobes according to the present invention made using the sintered powder metal alloy described herein, a number of cam lobes were fabricated from sintered articles having the composition identified as "Example 1" in Table 1. Cam lobes made of this sintered powder metal alloy were tested in a standard industry test fixture as were several other sintered powder metal alloys of the types described herein. The results of these tests were compared to assess the wear performance improvement associated with articles according to the invention.

The cam lobes tested were made from alloys having the compositions generally described listed below:

Fe—Ni—Mo—C Alloy: Sinter hardened material; low density (~7.0 g/cm$^3$);

Fe—Mo—Cr—V—C Alloy: Invention material; Case hardened, medium density (7.0 to 7.3 g/cm$^3$);

Fe—Mo—C Alloy: Case hardened, high density (>7.25 g/cm$^3$); and

Fe—Mo—C Alloy: Case hardened, very high density (>7.4 g/cm$^3$);

The compositions of these alloys are given in Table 4.

TABLE 4

| Alloy | Alloying Elements; wt % | | | | | |
|---|---|---|---|---|---|---|
| | Cr | V | Ni | Mo | C | Fe |
| Fe—Ni—Mo—C | 0 | 0 | 1.80 | 0.83 | 0.85 | Balance |
| Fe—Mo—C | 0 | 0 | 0 | 0.87 | 0.85 | Balance |
| Fe—Mo—Cr—V—C | 2.00 | 1.00 | 0 | 0.85 | 0.70–1.20 | Balance |

The powder metal cam lobes used in the tests were made in the shape of a Ford 1.81 D exhaust profile and tested against 100Cr6 standard phosphated steel flat shims. Further limited tests were performed using powder metal steel flat shims.

An industry standard test fixture was used to assess the wear and scuffing performance of the cam lobes. The fixture was designed and manufactured by MIRA (UK Motor Industry Research Association) and is described in greater detail in the following references:

(1) Wykes, F C, "Summary Report on the Performance of a Number of Cam and Cam Follower Material Combinations Tested in the MIRA Cam and Follower Test Machine", MIRA Report No.3, 1970; and (2) Chatterley, T. C, "Cam and Cam Follower Reliability", SAE Paper 885033, 1988.

In the MIRA fixture testing, the cam is driven through a pulley connected to an electric motor. The follower (tappet) is positioned directly above the cam and a variable load is applied through a push rod by a spring loaded piston in the head assembly. Heated oil is pumped to the contact area through an oil jet positioned close to the cam and drains back to a reservoir. The number of revolutions during the test is recorded by a counter on the end of the camshaft. On each test head, a cam and follower pair are run at constant speed, load, oil temperature and oil flowrate for a set time. At the end of the test, the components are assessed by weight loss and are visually rated for pitting using an appropriate reference scale. For this particular test, test conditions were designed to cause wear of the components rather than introduce pitting and thus an additive free, low viscosity mineral oil, Largo P1, was chosen and run at a low speed of 500 rpm to minimize any hydrodynamic effects. The oil temperature was maintained at 100° C. for the test duration. The standard test was run for 50 hours with the phosphated 100Cr6 tappet.

The results of these tests are summarized in the Table shown in FIG. 8, and described further below.

Fe—Ni—Mo—C

The Fe—Ni—Mo—C alloy was tested first at 637 MPa for 50 hours. The cam nose was worn very badly with an extreme loss of cam lift. Reducing the stress to 500 MPa showed that the material wear was satisfactory with no wear apparent. This was confirmed in a second test. The limiting load was thus about 500 MPa.

Fe—Mo—C

The high density Fe—Mo—C material (density above 7.25 g/cm$^3$) also failed through high wear at 637 MPa and also at the lower stress of 500 MPa. Reducing the load further to 400 MPa allowed the cam to run satisfactorily, confirmed by a repeat test. The limiting load was thus about 400 MPa.

Fe—Mo—C

The very high density Fe-Mo-C (density above 7.4 g/cm$^3$) again failed through high wear at 637 MPa, but showed no wear at the lower stress of 500 MPa, again confirmed with a repeat test. Thus, the limiting load was determined to be about 500 MPa, similar to the Fe—Ni—Mo—C alloy.

Fe—Mo—Cr—V—C

The sintered alloy according to the invention showed no wear at the starting load of 637 MPa, unlike any of the other materials. Therefore, the test (sample A) was continued on to 100 hour duration, again with no distress or discernable wear. The repeat test (sample B) at 600 MPa was discontinued such that the lobe could be available if required for other trials. A third lobe (sample C) was tested against a powder metal shim at 600 MPa, and performed as well as for the 100Cr6 components.

Further tests at higher stresses were performed to establish its limit. At 700 MPa no wear was noted when running against either the 100Cr6 or PM tappet (samples B and D). Sample B was fitted with a new 100Cr6 shim for this higher load.

The test was accelerated to evaluate the performance of this material invention material with standard engine oil rather than the Largo P1 mineral oil. Also, a design limit of 827 MPa was imposed and thus samples E and F were tested using Ford AL 3612 engine oil at the slightly reduced stress of 800 MPa. Unfortunately owing to a fault with the fixture, it was not possible to run sample F at 500 rpm and so the test was run at 700 rpm for a proportionately shorter time such that the number of cycles was the same. Again no wear was seen for either shim.

The load was then increased to 850 MPa (using the same components) and both samples run on for a further 50 hours at 700 rpm. Again no wear was noted and so the load was increased further to 900 MPa. Thus, by the simple failure criteria of no obvious wear after 50 hours the invention material survives to at least 900 MPa.

The use of the base mineral oil Largo P1 provided a clear ranking of the four powder metal cam lobe materials. Only the material of the present invention was able to perform without significant wear at 600 MPa and above. The high density Fe—Mo—C alloy showed the poorest wear performance with a limit of 400 MPa while the Fe—Ni—Mo—C and the very high density Fe—Mo—C material showed wear at 500 MPa.

Further tests against both 100Cr6 and PM shims have shown the invention material to be capable of at least 900 MPa, a level which significantly exceeds typical operating loads.

Obviously, many modifications and variations of the present invention are possibly in light of the above teachings. It is therefore, to be understood that within the scope of the appended claims, the invention may be practiced otherwise than as specifically described. The invention is defined by the claims.

What is claimed is:

1. An Fe-based sintered powder metal article fabricated from an iron-based powder metal mixture consisting essentially of, by weight: 0.5–3.0% Mo, 1–6.5% Cr, 1–5% V, and the balance Fe and impurities.

2. The powder metal article of claim 1, wherein the Mo is added to the mixture as a Fe—Mo alloy powder consisting essentially of, by weight: 0.5–3.0% Mo, and the balance Fe and impurities.

3. The powder metal article of claim 1, wherein the Cr is added to the mixture as a ferro chromium powder.

4. The powder metal article of claim 3, wherein the ferro chromium powder is a high carbon ferro chromium powder.

5. The powder metal article of claim 1, wherein the V is added to the mixture as a ferro vanadium powder.

6. The powder metal article of claim 1, wherein the powder metal mixture is compacted to a density of between about 7.0–7.3 g/cm$^3$.

7. The powder metal article of claim 1, wherein said powder metal mixture is sintered at a temperature between about 1,121–1,260° C.

8. The powder metal article of claim 1, wherein said article comprises a cam lobe.

9. The sintered powder metal article of claim 1, wherein the article also comprises a carburized case extending inwardly from an outer surface.

10. The powder metal article of claim 9, wherein the case has a composition of 0.7–1.2% C by weight.

11. The powder metal article of claim 10, wherein the case extends inwardly from the surface between about 0.5–1.0 millimeters.

12. An Fe-based sintered powder metal cam lobe fabricated from an Fe-based powder metal mixture consisting essentially of, by weight: 0.5–3.0% Mo, 1–6.5% Cr, 1–5% V, and the balance Fe and impurities, said cam lobe having a carburized case comprising 0.7–1.2% C by weight.

13. The powder metal article of claim 12, wherein the Mo is added to the mixture as a Fe—Mo alloy powder consisting essentially of, by weight: 0.5–3.0% Mo and the balance Fe and impurities.

14. The powder metal article of claim 12, wherein the Cr is added to the mixture as a ferro chromium powder.

15. The powder metal article of claim 14, wherein the ferro chromium powder is a high carbon ferro chromium powder.

16. The powder metal article of claim 12, wherein the V is added to the mixture as a ferro vanadium powder.

17. The powder metal article of claim 12, wherein the powder metal mixture is compacted to a density of between about 7.0–7.3 g/cm$_3$.

18. The powder metal article of claim 12, wherein said powder metal admixture is compacted and sintered at a temperature of between about 1,121–1,260° C.

19. A cam shaft having at least one Fe-based sintered powder metal cam lobe fabricated from an Fe-based powder metal mixture consisting essentially of, by weight: 0.5–3.0% Mo, 1–6.5% Cr, 1–5% V, and the balance Fe and impurities, the cam lobe having a carburized case comprising 0.7–1.2% C by weight.

20. A method of making an Fe-based sintered powder metal article comprising the steps of:

preparing a powder metal admixture consisting essentially of, by weight: 0.5–3.0% Mo, 1–6.5% Cr, 1–5% V, with the balance Fe and impurities;

compacting the admixture to form the article;

sintering the article; and carburizing the article to form a carburized case extending inwardly from an outer surface of the article.

21. The method of claim 20, wherein the Mo is added to the admixture as a Fe—Mo alloy powder consisting essentially of, by weight: 0.5–3.0% Mo, and the balance Fe and impurities.

22. The method of claim 20, wherein the Cr is added to the admixture as a ferro chromium powder.

23. The method of claim 22, wherein the ferro chromium powder is a high carbon ferro chromium powder.

24. The method of claim 20, wherein the V is added to the mixture as a ferro vanadium powder.

25. The method of claim 20, wherein compacting the admixture is performed to achieve a density of between about 7.0–7.3 g/cm$^3$.

26. The method of claim 20, wherein sintering is performed at a temperature between about 1,121–1,260° C.

27. The method of claim 20, wherein the article comprises a cam lobe.

28. The method of claim 20, wherein the carburized case has a thickness of between about 0.5–1.0 mm.

29. The method of claim 20, wherein the case has a composition of about 0.7–1.2% C by weight.

30. The method of claim 20, further comprising the step of: quenching the article following said carburizing.

31. The method of claim 30, wherein the case comprises a martensite matrix microstructure.

32. The method of claim 31, wherein the case also comprises a network of disbursed carbides of Cr and V within the martensite matrix.

* * * * *

UNITED STATES PATENT AND TRADEMARK OFFICE

CERTIFICATE OF CORRECTION

PATENT NO. : 7,314,498 B2
APPLICATION NO. : 10/967983
DATED : January 1, 2008
INVENTOR(S) : Nigarura et al.

It is certified that error appears in the above-identified patent and that said Letters Patent is hereby corrected as shown below:

Column 9, line 23, “possibly” should be -- possible --.

Signed and Sealed this

Twenty-fourth Day of June, 2008

JON W. DUDAS
*Director of the United States Patent and Trademark Office*